United States Patent [19]

Humphreys et al.

[11] 3,969,897

[45] July 20, 1976

[54] TEMPERATURE-CONTROL ARRANGEMENT FOR A PAIR OF HYDRAULIC MOTORS

[75] Inventors: Rex T. Humphreys, Washington; Glenn J. Medina, Joliet; Patrick A. Parker, Morton, all of Ill.

[73] Assignee: Caterpillar Tractor Co., Peoria, Ill.

[22] Filed: Feb. 28, 1975

[21] Appl. No.: 554,346

[52] U.S. Cl. ..... 60/456; 60/484; 60/486; 60/905

[51] Int. Cl.[2] ..... F15B 21/04

[58] Field of Search ..... 60/456, 484, 486, DIG. 5, 60/905; 92/1

[56] References Cited

UNITED STATES PATENTS

| | | | |
|---|---|---|---|
| 2,961,829 | 11/1960 | Weisenbach | 60/456 X |
| 3,646,596 | 2/1972 | Bauer | 60/486 X |
| 3,659,419 | 5/1972 | Ikeda | 60/DIG. 5 |

*Primary Examiner*—Edgar W. Geoghegan
*Attorney, Agent, or Firm*—Phillips, Moore, Weissenberger Lempio & Strabala

[57] ABSTRACT

A hydraulic system having a plurality of hydraulic motors operated by fluid from a common reservoir includes means for circulating a flow of fluid from the reservoir through the housing of the motors to thereby maintain a substantially equal temperature between the motors and the fluid.

6 Claims, 3 Drawing Figures

TEMPERATURE-CONTROL ARRANGEMENT FOR A PAIR OF HYDRAULIC MOTORS

BACKGROUND OF THE INVENTION

The present invention relates to hydraulic control systems and pertains particularly to means for equalizing temperature within a hydraulic system.

Many hydraulic systems employ individual hydraulic circuits having separate pumps and motors drawing fluid from a common reservoir. Said systems are frequently employed in machines or on vehicles wherein one of the motors may operate substantially continuously and one or more of the motors may operate very infrequently. A motor that operates continuously generates a considerable amount of heat which is transferred to the fluid of the system. On the other hand, motors which operate very infrequently may have a temperature which is considerably below that of the motors which operate rather continuously. When fluid from a common reservoir is directed to a motor which is considerably cooler than the temperature of the fluid, the motor becomes subject to thermal shock by the hot fluid directed thereto. This is an especially severe problem in cold climates and during cold weather.

The heat from such hot fluid can cause distortion in the mechanical components of the motor which may result in the motor binding or components of the system cracking.

An example of such systems which employ separate circuits drawing fluid from the same reservoir is illustrated in U.S. Pat. No. 3,815,478 wherein the hydraulic system is utilized to operate the draw works of a pipelayer. In such a system the winch for manipulating the boom is normally operated by a rotary hydralic motor which is very infrequently used because the boom may stay in the same position for a considerable period of time. On the other hand, the winch motor which operates a winch for lifting loads suspended from the boom may be operated substantially continuously. Thus, the infrequently used motor may have a temperature which is considerably below that of the operating fluid. This is especially a problem in cold climates such as the Alaskan oil fields wherein pipelayer machines are extensively used to lay pipelines for transporting crude oil from the oil fields.

SUMMARY AND OBJECTS OF THE INVENTION

The primary object of the present invention is to overcome the above problems of the prior art.

Another object of the present invention is to provide a hydraulic system having means for equalizing the temperature throughout the system to prevent thermal shock to components thereof.

A further object of the present invention is to provide a hydraulic system with circulating means for circulating the fluid of the system through the motors of the system to maintain a substantially equal temperature of the motors and the fluid to prevent thermal shock thereof.

In accordance with the primary aspects of the present invention, a hydraulic system having a plurality of hydraulic motors operated by fluid from a common reservoir is provided with circulating means for circulating a flow of fluid from the common reservoir through the housing of the motors to thereby maintain a substantially equal temperature between the motors and the fluid and to assist in cooling the fluid.

BRIEF DESCRIPTION OF THE DRAWINGS

The above and other objects and advantages of the present invention will become apparent from the following description when read in conjunction with the drawings wherein.

DETAILED DESCRIPTION OF THE PREFERRED EMBODIMENT

Figure 1:
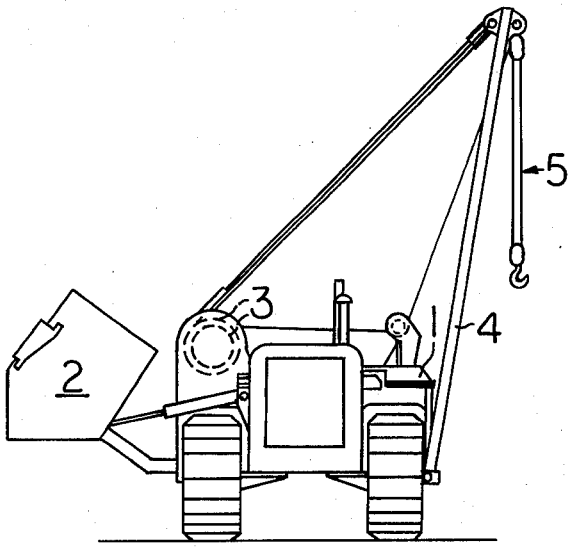
FIG. 1 is a front elevation of a pipelaying apparatus according to the invention mounted on a tractor.

As best seen in FIG. 1, the major components of a pipelaying apparatus which are mounted on a tractor comprise a saddle 1 which carries on one side a set of hydraulically controlled counterweights 2 and a pair of winches 3 which are driven by separate rotary hydraulic motors which will be further described later. A boom 4 is pivotally mounted at one end of the other side of the saddle and controlled by one of the winches. A hoist 5 is carried by the outer end of the boom and is raised and lowered by the other winch 3. The boom and hoist are independently operable, but may be operated simultaneously.

Figure 2:
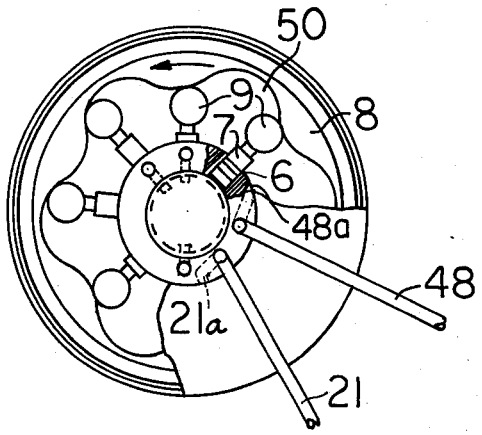
FIG. 2 is a diagrammatic view of a motor in accordance with the invention.

The hydraulic motors for powering the winches may be of any suitable rotary output type such as, for example, that illustrated in FIG. 2. The motor illustrated includes a stationary cylinder block 6 having a number of radial bores in which are reciprocably mounted a plurality of pistons 7. The pistons 7 are drivingly connected to an annular rotatable cam 8 by suitable cam followers such as rollers 9. Hydraulic fluid introduced into the cylinders displaces the pistons outward for engaging and driving the rotary cam which is operatively connected to a suitable output shaft or the like.

Figure 3:
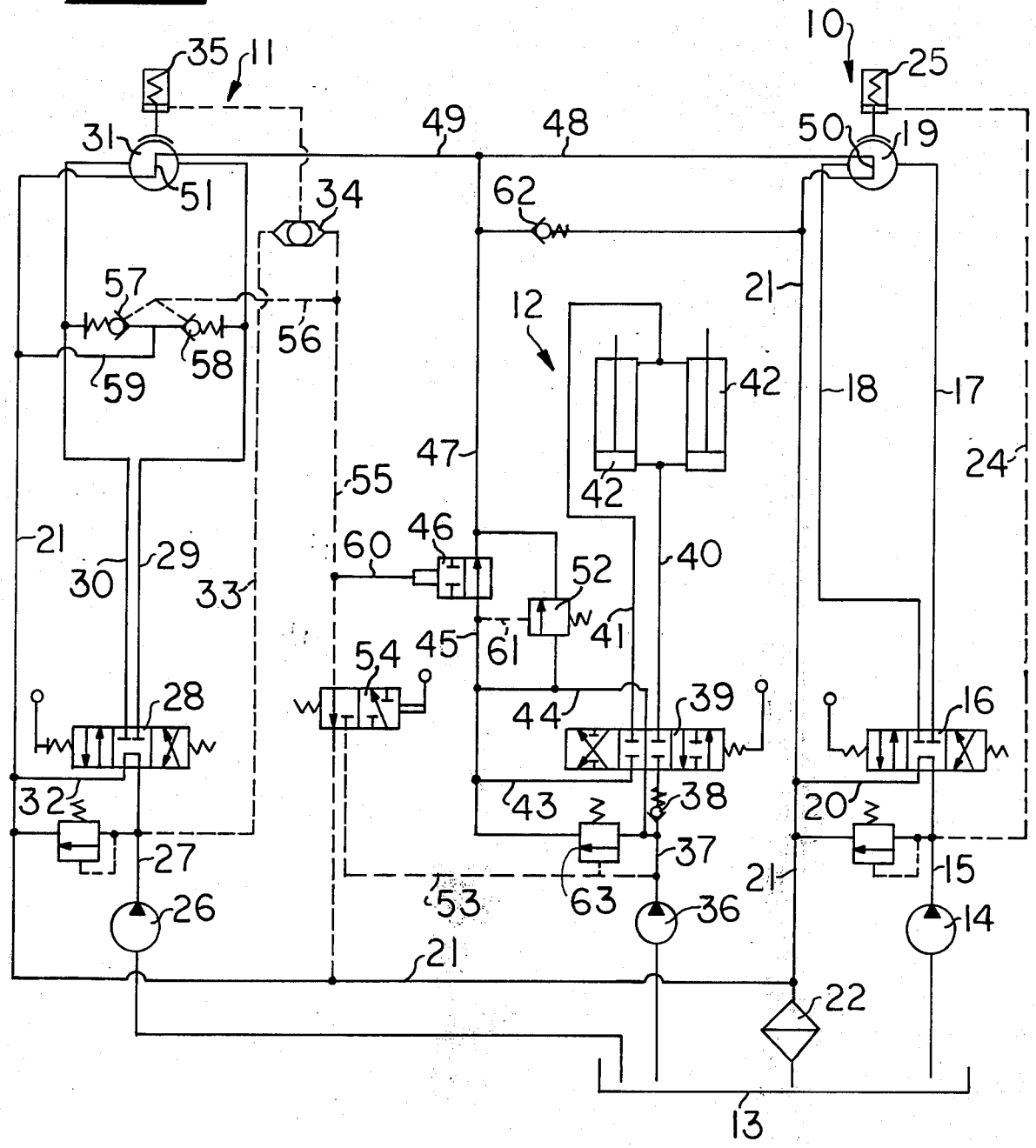
FIG. 3 is a schematic layout of a hydraulic system in accordance with the present invention.

For the purposes of illustration the motor illustrated in FIG. 2 will be taken to be motor 19 illustrated schematically in FIG. 3. In order to provide for the circulation of heating or cooling fluid, as the case may be, through the motor, the cylinder block is provided with an inlet port 48*a* and an outlet port 21*a*. An inlet supply line 48 of the circulation circuit communicates with inlet port 48*a* to supply circulating fluid thereto. The fluid flows through a suitable passage 50 within the motor housing and out outlet port 21*a* to the return line 21 and to reservoir 13. The passage 50 in this instance is simply the space within the housing between the cam 8 and the cylinder head 6. This passage 50 can, of course, take any other suitable form and any suitable course through the housing to perform its function.

Turning now to FIG. 3 of the drawing, there is illustrated a schematic layout of a hydraulic system having a plurality of individual circuits each having a separate motor and pump with each circuit drawing fluid from a common reservoir. The hydraulic system comprises a first circuit designated generally by the numeral 10, a second circuit designated generally by the numeral 11, and a third circuit designated generally by the numeral 12, each having a motor driven by fluid from a common reservoir 13.

The first circuit 10 is designated a boom circuit and comprises a pump 14 drawing fluid from the reservoir 13 and supplying it by way of a conduit or supply line 15 to a three-way directional control valve 16. The control valve 16 is operative in selective positions to direct the fluid alternately to one or more of the control lines 17 and 18 for operation of a rotary hydraulic motor 19 for driving the motor in a forward or reverse direction. The valve 16 is operated to connect supply line 15 with one of lines 17 or 18 and simultaneously therewith connecting the other line with a return line or passage 20 which connects with a return line 21 which conveys the fluid by way of a filter 22 back to reservoir 13. A pilot line 24 is operative to convey pilot fluid from supply line 15 to brake control means 25 for releasing brakes acting on motor 19 when a pressure build-up occurs in supply line 15. The circuit 10 is a boom control circuit for controlling the position of a boom on a pipelayer and is thus generally infrequently used.

The second circuit is a winch circuit for powering a winch for raising and lowering loads suspended from the boom of a hydraulic pipelayer. The second circuit includes or comprises a pump 26 which draws fluid from reservoir 13 and supplies it by way of a conduit or supply line 27 to a directional control valve 28. The directional control valve 28 is operative to selectively direct fluid to alternate ones of motor control lines 29 and 30 for operation of motor 31 in either one of a forward or reverse direction. The motor 31 is a rotary hydraulic motor for powering the winch of a pipelayer or the like. The valve 28 is operative to direct fluid along one of motor control lines 29 and 30 and simultaneously connecting the other of said lines to return line 21 by way of a return passage 32.

A pilot control line 33 communicates pressurized fluid from supply line 27 by way of shuttle valve 34 to brake control mechanism 35 for releasing brakes applied to motor 31 when supply line 27 is pressurized.

The third circuit is operative to operate counterweights and/or outriggers and the like of a machine such as a pipelayer. The third circuit comprises a pump 36 which draws fluid from the reservoir 13 and supplies it by way of a supply line 37 and an inlet check 38 to a directional control valve 39. The directional control valve 39 is operative to direct fluid by way of either one of motor control lines 40 or 41 to a pair of counterweight control jacks 42. The valve 39 is operative to connect one of the motor control lines 40 or 41 with supply line 39 while simultaneously connecting the other of said lines with a return passage 43 which connects to circulating lines, as will be described.

A circulating system for circulating fluid from the reservoir 13 through both of the motors 19 and 31 for the purposes of equalizing the temperature therein includes a through passage 44 which directs fluid across valve 39 when the valve is in its neutral position to a circulating line 45 which supplies it by way of pilot-operated valve 46 to a circulating line 47. The fluid is supplied along circulating line 47 to branch lines 48 and 49 which direct the fluid to the housings of motors 19 and 31. The fluid is conveyed through each of the respective motors where it is circulated through suitable passageways 50 and 51 within the housings of the respective motors to thereby effectively even or equalize the temperatures within the motors.

This circulating system works by conveying the fluid, which will be heated by operation of motor 31, to the motor 19 for heating that motor up and cooling the fluid so that the temperature of the motor becomes substantially equal to the fluid. At the same time the fluid circulated along 49 to motor 31 will be slightly cooler than that motor, and consequently will act to substantially cool that motor with respect to the fluid and thereby substantially equalize the temperatures between the fluid and the motors. It will be seen also that the motor 19, being substantially cooler than the fluid in conduit 48, will also act as cooling means for that fluid.

The circulating system also includes a bypass valve 52 which is operative to bypass valve 46 when the latter valve is temporarily closed. A free-run circuit, including a pilot line 53, is operative to convey pilot fluid from supply line 37 of the third circuit 12 to a selector valve 54 which is operative to direct the fluid along a line 55 by way of shuttle valve 34 for releasing brake control mechanism 35 and to direct the fluid along a branch line 56 for releasing a pair of load check valves 57 and 58 for venting both motor lines 29 and 30. The releasing of the check valves 57 and 58 permits fluid to flow from the motor control lines 29 and 30 by way of a return passage 59 to return line 21 and permits the motor 31 to run free.

The pilot fluid directed along line 55 also flows by way of line 60 to shift valve 46 to temporarily block the circulating lines 45 and 47. This will ensure sufficient build-up of pressure within the pilot lines 53 and 55 to operate the brake control mechanism 35 and the check valves 57 and 58. While valve 46 blocks the lines 45 and 47, the build-up of pressure in line 45 begins to operate by way of a pilot line 61 to shift bypass valve 52 to the right to bypass the valve 46 so that fluid can again begin to circulate within the circulating system. A relief valve 62 is provided between the circulating line 47 and return line 21 to prevent overpressurization of the circulating system, such as during start-up periods when the fluid of the system is cold and highly viscous. A relief valve 63 is provided in supply line 37 for relieving excess pressure therein. Such valve would, for example, become operative when the motors 42 reached the limit of their travel with valve 37 retained in its operating position.

It will be seen from this system that when valve 39 is in neutral position fluid from pump 36 is circulating through the circulating system through the housings of motors 31 and 19 to thereby equalize the temperatures between the circulating fluids from the common reservoir 13 and the motors 19 and 31. When valve 39 is shifted to either one of its operative positions for operating motors 42, the flow of fluid from pump 36 by way of conduit 44 is temporarily cut off so that all the fluid will thereby be directed to operate motors 42. Upon motors 42 reaching the end of their travel, however, relief valve 63 becomes immediately operative and fluid flows by way of the relief valve 63 into line 45 and through the circulating system. As soon as valve 39 is returned to its neutral positon, fluid again flows along line 44 to the circulating system line 45 and through the circulating system.

From the above description it will be seen that there is provided a hydraulic system having a plurality of hydraulic motors operated by fluid from a common reservoir wherein circulating means are provided for circulating flow of fluid from the common reservoir through the housings of the motors to thereby maintain a substantially equal temperature between the motors and the fluid to thereby prevent thermal shock within the system.

The present invention has been described by means of a single embodiment. It is to be understood that numerous changes and modifications may be made therein without departing from the spirit and scope of the invention as defined by the appended claims.

What is claimed is:

1. In a hydraulic system having a plurality of hydraulic motors operated by fluid from a common reservoir, and incorporated in a pipelayer having a movable boom, a winch suspended from said boom, an extensible counterweight for countering the load on said boom, a first circuit including a rotary hydraulic motor for operation of said boom, a second circuit including a rotary hydraulic motor for operation of said winch, and a third circuit including a motor for operation of said counterweights, and a separate pump for each of said circuits, the improvement comprising:

circulating means for circulating a flow of fluid from said reservoir through the housings of said motors to thereby maintain a substantially equal temperature between said motors and said fluid, said circulating means including conduit means operatively connected for circulating fluid from said pump for said counterweight circuit through said rotary hydraulic motors.

2. The hydraulic system of claim 1 comprising a free-run circuit for said motor of said winch circuit; and a pressure-responsive valve responsive to pressure in said free-run circuit for temporarily halting circulation of fluid through said circulating means.

3. The hydraulic system of claim 1 wherein one of said rotary motors is operated frequently and the other is operated infrequently.

4. In a hydraulic system having a plurality of hydraulic motors operated by fluid from a common reservoir incorporated in a pipelayer having a movable boom, a winch suspended from said boom, an extensible counterweight for countering the load on said boom, a first circuit including a first pump and a rotary hydraulic motor for operation of said boom, a second circuit including a second pump and a rotary hydraulic motor for operation of said winch, a third circuit including a motor for operation of said counterweights, and a separate pump for said third circuit, the improvement comprising:

circulating means for circulating a flow of fluid from said reservoir through the housings of said motors to thereby maintain a substantially equal temperature between said motors and said fluid, said circulating means includes conduit means operatively connected for circulating fluid from said pump for said counterweight circuit through said rotary hydraulic motors.

5. The hydraulic system of claim 4 comprising a free-run circuit for said motor of said winch circuit; and a pressure-responsive valve responsive to pressure in said free-run circuit for temporarily halting circulation of fluid through said circulating means.

6. The hydraulic system of claim 4 wherein one of said of rotary motors is operated frequently and the other is operated infrequently.

* * * * *